US007914966B2

(12) United States Patent
Savariar-Hauck et al.

(10) Patent No.: US 7,914,966 B2
(45) Date of Patent: Mar. 29, 2011

(54) MODIFIED POLYMERS AND THEIR USE IN THE PRODUCTION OF LITHOGRAPHIC PRINTING PLATE PRECURSORS

(75) Inventors: Celin Savariar-Hauck, Badenhausen (DE); Alan S. Monk, Cheshire (GB); Rene Ullrich, Trebitz (DE)

(73) Assignee: Eastman Kodak Company, Rochester, NY (US)

( * ) Notice: Subject to any disclaimer, the term of this patent is extended or adjusted under 35 U.S.C. 154(b) by 716 days.

(21) Appl. No.: 11/570,079

(22) PCT Filed: Jun. 15, 2005

(86) PCT No.: PCT/EP2005/006426

§ 371 (c)(1),
(2), (4) Date: Dec. 6, 2006

(87) PCT Pub. No.: WO2005/123412

PCT Pub. Date: Dec. 29, 2005

(65) Prior Publication Data

US 2007/0269727 A1 Nov. 22, 2007

(30) Foreign Application Priority Data

Jun. 18, 2004 (DE) ..... 10 2004 029 501

(51) Int. Cl.
*G03C 1/00* (2006.01)

(52) U.S. Cl. ..... 430/270.1; 430/273.1; 430/286.1; 430/281.1

(58) Field of Classification Search ..... 430/270.1, 430/273.1
See application file for complete search history.

(56) References Cited

U.S. PATENT DOCUMENTS

| | | | | |
|---|---|---|---|---|
| 5,731,127 | A * | 3/1998 | Ishizuka et al. | 430/270.1 |
| 5,919,601 | A * | 7/1999 | Nguyen et al. | 430/278.1 |
| 6,294,311 | B1 * | 9/2001 | Shimazu et al. | 430/271.1 |
| 6,352,811 | B1 * | 3/2002 | Patel et al. | 430/270.1 |
| 6,358,669 | B1 * | 3/2002 | Savariar-Hauck et al. | 430/273.1 |
| 6,924,035 | B2 * | 8/2005 | Auweter et al. | 428/407 |
| 2002/0020318 | A1 | 2/2002 | Galloway et al. | |
| 2004/0131973 | A1 * | 7/2004 | Tao et al. | 430/302 |
| 2004/0144277 | A1 * | 7/2004 | Collins et al. | 101/467 |
| 2004/0180285 | A1 * | 9/2004 | Tao et al. | 430/270.1 |
| 2004/0259027 | A1 * | 12/2004 | Munnelly et al. | 430/270.1 |

FOREIGN PATENT DOCUMENTS

| | | |
|---|---|---|
| EP | 1226936 | 7/2002 |
| EP | 1281515 | 2/2003 |
| EP | 1338435 | 8/2003 |
| WO | WO 03068873 A1 * | 8/2003 |

* cited by examiner

*Primary Examiner* — Cynthia H Kelly
*Assistant Examiner* — Connie P Johnson
(74) *Attorney, Agent, or Firm* — J. Lanny Tucker

(57) ABSTRACT

Radiation-sensitive negative working element comprising (a) a substrate with a hydrophilic surface and (b) a layer on the hydrophilic surface of the substrate, wherein said layer comprises a modified polymer obtainable by reacting (i) a polymer with —COOH, —SO3H, —P03H2 and/or —PO4H2 in the side chains, wherein the polymer is soluble in aqueous alkaline solutions and the solubility is not changed by IR radiation, and (ii) a salt with an inorganic or organic cation, wherein the modified polymer is soluble in aqueous alkaline solutions and the solubility is not changed by IR radiation, said layer being soluble in aqueous alkaline developer, but is rendered insoluble in aqueous alkaline developer by IR radiation.

13 Claims, No Drawings

MODIFIED POLYMERS AND THEIR USE IN THE PRODUCTION OF LITHOGRAPHIC PRINTING PLATE PRECURSORS

The present invention relates to modified polymers, the production thereof and their use in the production of radiation-sensitive elements such as e.g. lithographic printing plate precursors.

The technical field of lithographic printing is based on the immiscibility of oil and water, wherein the oily material or the printing ink is preferably accepted by the image area, and the water or fountain solution is preferably accepted by the non-image area. When an appropriately produced surface is moistened with water and a printing ink is applied, the background or non-image area accepts the water and repels the printing ink, while the image area accepts the printing ink and repels the water. The printing ink in the image area is then transferred to the surface of a material such as paper, fabric and the like, on which the image is to be formed. Generally, however, the printing ink is first transferred to an intermediate material, referred to as blanket, which then in turn transfers the printing ink onto the surface of the material on which the image is to be formed; this technique is referred to as offset lithography.

A frequently used type of lithographic printing plate precursor (in this context the term printing plate precursor refers to a coated printing plate prior to exposure and developing) comprises a photosensitive coating applied onto a substrate on aluminum basis. The coating can react to radiation such that the exposed portion becomes so soluble that it is removed during the developing process. Such a plate is referred to as positive working. On the other hand, a plate is referred to as negative working if the exposed portion of the coating is hardened by the radiation. In both cases, the remaining image area accepts printing ink, i.e. is oleophilic, and the non-image area (background) accepts water, i.e. is hydrophilic. The differentiation between image and non-image areas takes place during exposure.

In conventional plates, a film containing the information to be transferred is attached to the plate precursor under vacuum in order to guarantee good contact. The plate is then exposed by means of a radiation source, part of which is comprised of UV radiation. When a positive plate is used, the area on the film corresponding to the image on the plate is so opaque that the light does not attack the plate, while the area on the film corresponding to the non-image area is clear and allows light to permeate the coating, whose solubility increases. In the case of a negative plate, the opposite takes place: The area on the film corresponding to the image on the plate is clear, while the non-image area is opaque. The coating beneath the clear film area is hardened due to the incident light, while the area not affected by the light is removed during developing. The light-hardened surface of a negative working plate is therefore oleophilic and accepts printing ink, while the non-image area that used to be coated with the coating removed by the developer is desensitized and therefore hydrophilic.

For several decades, positive working commercial printing plate precursors have been characterized by the use of alkali-soluble phenolic resins and naphthoquinone diazide derivatives; imaging was carried out with UV radiation.

Recent developments in the field of lithographic printing plate precursors have led to radiation-sensitive compositions suitable for the production of printing form precursors which can be addressed directly by lasers. The digital image-forming information can be used to convey an image onto a printing form precursor without the use of a film, as is common in conventional plates.

During the last few years, increased research and development has been done in the field of heat-sensitive printing plate precursors (often referred to as "thermoplates"). These plates are imaged by means of heat or radiation (such as IR radiation) which is converted into heat by a photothermal converting material (e.g. an IR absorber).

One example of a positive working, direct laser-addressable printing plate precursor is described in U.S. Pat. No. 4,708,925. The patent describes a lithographic printing plate precursor whose imaging layer comprises a phenolic resin and a radiation-sensitive onium salt. As described in the patent, the interaction between the phenolic resin and the onium salt results in an alkali solvent resistance of the composition, which restores the alkali solubility by photolytic decomposition of the onium salt. The printing form precursor can be used as a precursor of a positive working printing form or as a precursor of a negative printing form, if additional process steps are carried out between exposure and developing, as described in detail in British patent no. 2,082,339. The printing form precursors described in U.S. Pat. No. 4,708,925 are UV-sensitive per se and can additionally be sensitized to visible and infrared radiation.

Another example of a direct laser-addressable printing form precursor that can be used as a positive working system is described in U.S. Pat. No. 5,372,907 and U.S. Pat. No. 5,491,046. These two patents describe the decomposition of a latent Bronsted acid by radiation in order to increase solubility of the resin matrix upon image-wise exposure. As in the case of the printing form precursor described in U.S. Pat. No. 4,708,925, these systems can also be used as negative working systems in combination with additional process steps between imaging and developing. In the case of the negative working printing plate precursors, the decomposition by-products are subsequently used to catalyze a crosslinking reaction between the resins in order to render the layer of the exposed areas insoluble, which requires a heating step prior to developing. As in U.S. Pat. No. 4,708,925, these printing form precursors per se are UV-sensitive due to the acid-forming materials used.

U.S. Pat. No. 5,658,708 describes positive and negative working thermally imageable elements. In the case of the negative working elements, the coating, which is applied in one step, for example comprises a compound with at least two enolether groups and an alkali-soluble resin with acid groups capable of reacting with the enolether groups upon heating. Drying is carried out at a relatively low temperature. During the image-forming step, the coating is image-wise heated to a high temperature resulting in cross-linking which in turn renders the coating insoluble in the developer. In the case of positive working elements, the coating for example additionally comprises an acid former; drying is carried out at relatively high temperatures so that cross-linking of the coating of the unimaged element takes place, which coating is then insoluble in the developer. Image-wise exposure to IR radiation then renders the coating soluble in the developer. The use of acid generating compounds has the disadvantage that it renders the plate sensitive to UV light and thus also daylight (also in the sense of normal room light).

The document DE 198 50 181 describes printing plate precursors whose radiation-sensitive layer comprises a polymeric binder, a compound that releases an acid when heated, a photothermal conversion material and a cross-linkable polyfunctional enolether, wherein the polymeric binder both comprises protective groups that can be cleaved off by acid or heat and functional groups that allow cross-linking with enolethers, and wherein the binder is insoluble in aqueous alkaline media with a pH<13.5.

U.S. Pat. No. 5,858,626 describes a positive working heat-sensitive lithographic printing plate precursor with a single-layer structure. The heat-sensitive layer comprises an IR absorber and a phenolic resin which is either present in admixture with an o-diazonaphthoquinone derivative or has been reacted with one.

The document WO 97/39894 A1 describes oleophilic heat-sensitive compositions for coating lithographic printing plate precursors comprising a developer-soluble polymer and a compound that reduces the developer-solubility of the polymer; it is assumed that a thermally unstable complex is formed.

The document WO 99/11458 A1 describes single-layer heat-sensitive elements such as printing plate precursors whose heat-sensitive coating becomes temporarily soluble in the developer due to exposure to IR radiation.

U.S. Pat. Nos. 6,352,811 B1; 6,352,812 B1; and 6,358,669 B1 each describe positive working thermoplates with a dual-layer structure. These thermoplates exhibit excellent radiation sensitivity; however, their solvent resistance does not fulfill the highest standards.

U.S. Pat. No. 6,506,533 B1 describes polymers with IR-absorbing side chain which are insoluble in aqueous alkaline developer but are rendered soluble in aqueous alkaline developer upon exposure to IR radiation; their use in lithographic printing plate precursors is described as well.

U.S. Pat. No. 6,124,425 describes a polymer absorbing in the IR range comprising IR-absorbing repeating units, repeating units for processability and thermally reactive repeating units; the polymer is used for coatings that can be imaged directly with lasers.

It is the object of the present invention to provide heat-sensitive elements such as lithographic printing plate precursors, with improved solvent resistance without compromising radiation sensitivity.

This object is achieved on the one hand by a negative working radiation-sensitive element comprising (a) a substrate with a hydrophilic surface and (b) a layer on the hydrophilic surface of the substrate, wherein said layer comprises a modified polymer obtainable by reacting (i) a polymer with —COOH, —$SO_3H$, —$PO_3H_2$ and/or —$PO_4H_2$ in the side chains, wherein the polymer is soluble in aqueous alkaline solutions and the solubility is not changed by IR radiation, and (ii) a salt with an inorganic or organic cation, wherein the modified polymer is soluble in aqueous alkaline solutions and the solubility is not changed by IR radiation, said layer being soluble in aqueous alkaline developer, but is rendered insoluble in aqueous alkaline developer by IR radiation, and on the other hand by a positive working radiation-sensitive element comprising (a) a substrate with a hydrophilic surface, (b) a first layer on the hydrophilic surface and (c) a top layer, wherein the first layer comprises a modified polymer as defined in claims 1 to 8, is soluble in aqueous alkaline developer and the solubility is not changed by IR radiation and wherein the top layer is insoluble in or impenetrable by aqueous alkaline developer, but is rendered soluble in or penetrable by aqueous alkaline developer by IR radiation.

Unless defined otherwise, the term "alkyl group" as used in the present invention refers to a straight-chain, branched or cyclic saturated hydrocarbon group which preferably comprises 1 to 18 carbon atoms, more preferred 1 to 10 carbon atoms and most preferred 1 to 6 carbon atoms. The alkyl group can optionally comprise one or more substituents (preferably 0 or 1 substituent), for example selected from halogen atoms (fluorine, chlorine, bromine, iodine), CN, $NR^{20}{}_2$, $C(O)OR^{20}$ and $OR^{20}$ ($R^{20}$ independently represents a hydrogen atom, an alkyl group, aryl group or aralkyl group). The above definition also applies to the alkyl unit of an aralkyl group and an alkylene group.

Unless defined otherwise, the term "aryl group" as used in the present invention refers to an aromatic carbocyclic group with one or more fused rings, which preferably comprises 6 to 14 carbon atoms. The aryl group can optionally comprise one or more substituents (preferably 0 to 3) selected for example from halogen atoms, alkyl groups, alkoxy groups, CN, $NR^{20}{}_2$, $SO_3H$, $COOR^{20}$ and $OR^{20}$ (wherein each $R^{20}$ is independently selected from hydrogen, alkyl, aryl and aralkyl). The above definition also applies to the aryl unit of an aralkyl group and an arylene group. Preferred examples include a phenyl group and a naphthyl group which can optionally be substituted.

A fused ring or ring system as referred to in the present invention is a ring that shares two atoms with the ring to which it is fused.

Unless defined otherwise, the term "heterocyclic group" as used in the present invention refers to a 5- to 7-membered (preferably 5- or 6-membered) saturated, unsaturated (non-aromatic) or aromatic ring, wherein one or more ring carbon atoms are replaced with heteroatoms selected from N, $NR^{20}$, S and O (preferably N or $NR^{20}$). The heterocyclic ring can optionally comprise one or more substituents, selected for example from alkyl groups, aryl groups, aralkyl groups, halogen atoms, —$OR^{20}$, —$NR^{20}{}_2$, —$C(O)OR^{20}$, $C(O)NR^{20}{}_2$ and CN (wherein each $R^{20}$ is independently selected from hydrogen, alkyl, aryl and aralkyl).

As referred to in the present invention, a carbocyclic ring is a 5- to 7-membered (preferably 5- or 6-membered) saturated or unsaturated ring. The carbocyclic ring can optionally comprise one or more substituents, selected for example from alkyl groups, aryl groups, aralkyl groups, halogen atoms, CN, —$NR^{20}{}_2$, —$C(O)OR^{20}$, —$C(O)NR^{20}{}_2$ and —$OR^{20}$ (wherein $R^{20}$ is as defined above).

The gist of the present invention is the modification of a polymer comprising acidic groups selected from —COOH, —$SO_3H$, —$PO_3H_2$ and —$PO_4H_2$ in the side chains (in the following also briefly referred to as "starting polymer") by reacting it with a salt.

All polymers (including copolymers) which (1) comprise one or more acidic groups selected from —COOH, —$SO_3H$, —$PO_3H_2$ and —$PO_4H_2$ in the side chains, (2) are soluble in aqueous alkaline solutions and (3) whose solubility in aqueous alkaline solution is not changed by IR radiation can be used as starting polymers.

Examples of suitable starting polymers are briefly described in the following.

The polymer used in the present invention can for example be selected from acidic polyvinyl acetals, e.g. polyvinyl acetals comprising the following structural units A, B, C and D:

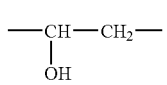

(A)

-continued (B)

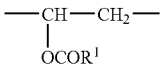

(C)

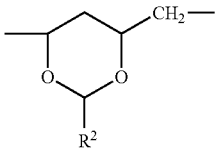

wherein D is at least one unit selected from D-1, D-2 and D-3 ist:

(D-1)

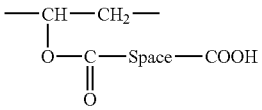

(D-2)

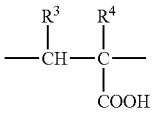

(D-3)

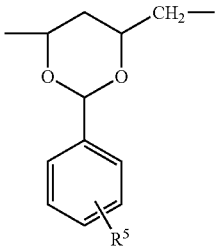

wherein $R^1$ represents H or $C_1$-$C_4$ alkyl (preferably H, —$CH_3$, —$CH_2CH_3$, especially preferred —$CH_3$), $R^2$ represents H or $C_1$-$C_{18}$ alkyl (preferably —$CH_3$, —$CH_2CH_3$, —$(CH_2)_2CH_3$, especially preferred —$CH_2CH_3$), $R^3$ represents H or $C_1$-$C_4$ alkyl (preferably H, —$CH_3$, —$CH_2CH_3$, especially preferred H), $R^4$ represents H or $C_1$-$C_4$ alkyl (preferably H, —$CH_3$, —$CH_2CH_3$, especially preferred H), $R^5$ represents —COOH, —$(CH_2)_a$—COOH, —O—$(CH_2)_a$—COOH, —$SO_3H$, —$PO_3H_2$ or —$PO_4H_2$ (preferably —COOH, —$SO_3H$, —$PO_3H_2$, especially preferred —COOH), and a is an integer from 1 to 8 (preferably 1 to 4, especially preferred 1).

"Space" is selected from $$—(CR^6R^7)_k— \text{ and } —CR^8{=}CR^9—$$

wherein k is an integer from 1 to 6, each $R^6$ and $R^7$ is independently selected from a hydrogen atom and a $C_1$-$C_6$ (preferably $C_1$-$C_4$) alkyl group (if k>1, not all groups $R^6$ have to be the same, nor do all groups $R^7$ have to be the same), and $R^8$ and $R^9$ are independently selected from a hydrogen atom and a $C_1$-$C_6$ (preferably $C_1$-$C_4$) alkyl group, or $R^8$ and $R^9$, together with the two carbon atoms to which they are bonded, form an optionally substituted aryl or heteroaryl group. (The optionally substituted aryl group can e.g. be an optionally substituted phenyl or naphthyl group, with an unsubstituted phenyl group being preferred. The optionally substituted heteroaryl group usually comprises 5 or 6 ring atoms, one or more of which (preferably 1 or 2) are heteroatoms selected from sulfur, oxygen and nitrogen atoms. Preferred heteroaryl groups comprise 1 oxygen atom, 1 sulfur atom or 1 to 2 nitrogen atoms. Suitable substituents for the aryl and heteroaryl group include $C_1$-$C_4$ alkyl groups, halo($C_1$-$C_4$ alkyl) groups, cyano groups, $C_1$-$C_4$ alkoxy groups and —COOH. The number of substituents—if present—is usually 1 to 3; however, unsubstituted aryl and heteroaryl groups are preferred.)

It is especially preferred that "Space" be selected from:

$$—CR^{10}R^{11}—CR^{12}R^{20}—;\ —CR^{14}{=}CR^{15}—$$

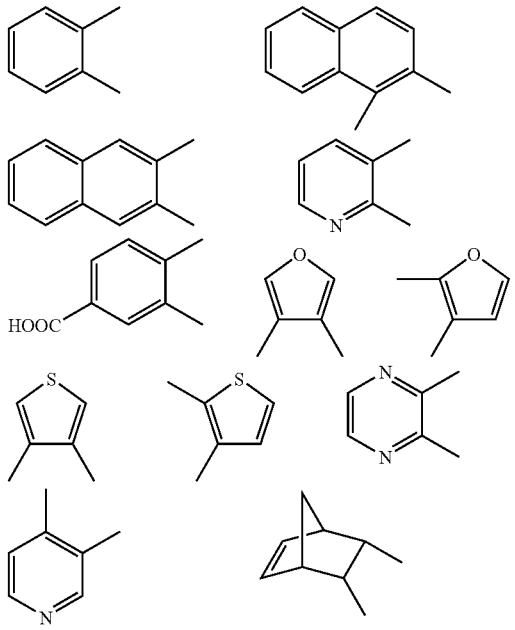

wherein $R^{10}$ to $R^{15}$ are each independently selected from a hydrogen atom and a $C_1$-$C_6$ alkyl group.

It is preferred that the polyvinyl acetals used in the present invention have an acid value of at least 10 mg KOH/g polymer, especially preferred at least 70 mg KOH/g polymer. Preferably, the acid value is not higher than 150 mg KOH/g polymer, more preferred not higher than 100 mg KOH/g polymer. The "acid value" indicates the number of mg of KOH necessary to neutralize 1 g of polymer.

Polyvinyl acetals comprising several different units B and/or C and/or D can also be used in the present invention. The ratio of units A, B, C and D in the polyvinyl acetals of the present invention is not particularly restricted; however, they are preferably present in the following amounts:

Unit A 10 to 40 wt.-% (especially preferred 15 to 30 wt.-%), unit B 0.1 to 25 wt.-% (especially preferred 1 to 15 wt.-%), unit C 10 to 80 wt.-% (especially preferred 25 to 65 wt.-%) and unit D 1 to 40 wt.-% (especially preferred 10 to 20 wt.-%), each based on the total weight of the acetal polymer.

If several different units B are present, the amount given refers to the total number of units B. The same applies to units C and D.

The vinyl alcohol/vinyl acetate copolymers that serve as starting materials in the preparation of the acidic polyacetals of the present invention are preferably hydrolyzed to a degree of 70 to 98 mole-% and usually have a weight-average molecular weight $M_w$ of 20,000 to 130,000 g/mole. Exactly which copolymer is used as a starting material for the synthesis depends on the desired future application of the heat-sensitive element. For offset printing plates, polymers with a weight-average molecular weight $M_w$ of 35,000 to 130,000 g/mole and a degree of hydrolysis of the vinyl acetate structural unit of 80 to 98 mole-% are preferably used.

The acidic polyvinyl acetals can be prepared using known methods. Acidic polyvinyl acetals suitable for the present invention and their preparation are described in detail e.g. in U.S. Pat. No. 5,169,897, DE-B-34 04 366 and DE-A-100 11 096.

(Meth)acrylic acid polymers and copolymers, e.g. (meth) acrylic acid ester/(meth)acrylic acid copolymers, are also suitable as starting polymer, in particular those with acid values of about 50 to 100. In this connection, the copolymer group with the trade name "Carboset®", such as Carboset XL 11®, Carboset 514®, Carboset 525® and Carboset 526® (acrylic acid/ethyl acrylate/methyl methacrylate copolymers), Carboset 14® and Carboset 15® (low-alkyl acrylate/(meth)acrylic acid copolymers) and Carboset 515® (acrylic acid polymer), commercially available from B.F. Goodrich, should for example be mentioned.

Derivatives of methylvinylether/maleic acid anhydride copolymers and derivatives of styrene/maleic acid anhydride copolymers comprising an N-substituted cyclic imide unit and a group COOH can also be used as starting polymer. Such copolymers can for example be prepared by reacting maleic acid anhydride copolymer and an amine such as p-aminobenzoic acid and subsequent cyclization by means of an acid.

Further suitable starting polymers are derived from N-substituted maleimides, in particular N-phenylmaleimide, (meth)acrylamides, in particular methacrylamide, and acrylic acid and/or methacrylic acid, in particular methacrylic acid. It is more preferred that all three monomers be present in polymerized form. Preferred copolymers of that type are copolymers of N-phenylmaleimide, (meth)acrylamide and (meth) acrylic acid, more preferred those comprising 25 to 75 mole-% (more preferred 35 to 60 mole-%) N-phenylmaleimide, 10 to 50 mole-% (more preferred 15 to 40 mole-%) (meth)acrylamide and 5 to 30 mole-% (more preferred 10 to 30 mole-%) (meth)acrylic acid.

Copolymers comprising a monomer in polymerized form which contains a urea group in its side chain constitute another group of polymers that can be used in the present invention; such copolymers are e.g. described in U.S. Pat. No. 5,731,127 B. These copolymers comprise 10 to 80 wt.-% (preferably 20 to 80 wt.-%) of at least one monomer of formula (I) below:

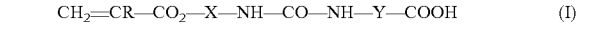

$$CH_2{=}CR{-}CO_2{-}X{-}NH{-}CO{-}NH{-}Y{-}COOH \quad (I)$$

wherein

R is a hydrogen atom or a methyl group,

X is a divalent linking group,

Y is a divalent substituted or unsubstituted aromatic group, and

R is preferably a methyl group.

X is preferably a substituted or unsubstituted alkylene group, a substituted or unsubstituted phenylene group ($C_6H_4$) or a substituted or unsubstituted naphthalene group ($C_{10}H_6$), such as —$(CH_2)_n$ (wherein n is an integer from 2 to 8), 1,2-, 1,3- and 1,4-phenylene and 1,4-, 2,7- and 1,8-naphthalene. More preferred, X is an unsubstituted alkylene group —$(CH_2)_n$— wherein n=2 or 3, and most preferred, X represents —$(CH_2CH_2)$—.

Y is preferably a substituted or unsubstituted phenylene group or a substituted or unsubstituted naphthalene group. More preferred, Y is an unsubstituted 1,4-phenylene group. A preferred monomer is

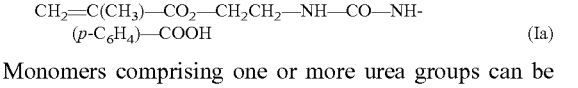

$$CH_2{=}C(CH_3){-}CO_2{-}CH_2CH_2{-}NH{-}CO{-}NH{-}(p\text{-}C_6H_4){-}COOH \quad (Ia)$$

Monomers comprising one or more urea groups can be used in the synthesis of the copolymers. In polymerized form, the copolymers furthermore comprise 20 to 90 wt.-% of other polymerizable monomers such as maleimide, acrylic acid, methacrylic acid, acrylic acid esters, methacrylic acid esters, acrylonitrile, methacrylonitrile, acrylamides and methacrylamides. Preferably, the copolymers soluble in alkaline solutions comprise 30 to 70 wt.-% of the monomer with urea group, 20 to 60 wt.-% acrylonitrile or methacrylonitrile (preferably acrylonitrile) and 5 to 25 wt.-% acrylamide or methacrylamide (preferably methacrylamide).

In order to obtain the modified polymers, the starting polymers are reacted with a salt.

The cation of the salt can be inorganic, such as an alkaline metal cation (e.g. $Li^+$) or an alkaline-earth metal cation, or organic; preferably, it is a monovalent cation. Organic cations are preferred, and it is especially preferred that the cation is the IR-absorbing cation of an IR absorber salt or the chromophoric cation of a dye salt.

Suitable organic cations can for example include those with a positively charged (i.e. quaternized) N atom, such as ammonium cations $NR'_4{}^+$ (wherein each R' is independently selected from H and $C_1$-$C_{20}$, preferably $C_1$-$C_{12}$ alkyl) quinolinium cations, benzothiazolium cations, pyridinium cations and imidazolium cations. Examples of imidazolium cations include the cations of Monazolin® C, Monazolin® 0, Monazolin® CY and Monazolin® T, which are all available from Mona Industries. Examples of quinolinium cations include 1-ethyl-2-methyl-quinolinium and 1-ethyl-4-methyl-quinolinium. Examples of benzothiazolium cations include 3-ethyl-2(3H)-benzothiazolylidene-2-methyl-1-(propenyl) benzothiazolium and 3-ethyl-2-methyl-benzo-thiazolium.

The term "IR-absorber salt" as used in the present invention relates to a salt which is capable of absorbing IR radiation and converting it into heat, and which is present in the form of a salt. Its chemical structure is not particularly restricted, as long as it is a salt consisting of a separate cation and anion (i.e. no internal salt) and the cation is responsible for IR absorption. It is preferred that the IR absorber salt show essential absorption in the range of 750 to 1,300 nm, and it preferably shows an absorption maximum in that range. IR absorber salts showing an absorption maximum in the range of 800 to 1,100 nm are especially preferred. It is furthermore preferred that the IR absorber salt does not or not substantially absorb radiation in the UV range. The IR absorber salts are for example selected from dyes of the thiazolium, cyanine, indolizine, pyrylium, thiapyrylium, selenium, benzothiazolium, benzoxazolium, quinolinium, indolium, and immonium classes, especially preferred from the cyanine class, but they have to be present in the form of a salt. For example, the compounds mentioned in Table 1 of WO 00/29214 which are present in the form of a salt and whose cation is the IR-absorbing portion are suitable IR absorbers.

According to one embodiment, a cyanine dye of the formula (III)

(III)

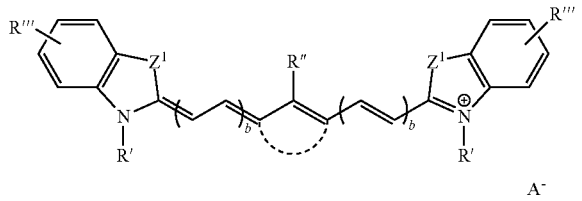

is used as a salt, wherein each $Z^1$ independently represents S, O, $NR^{IV}$ or $C(alkyl)_2$;

each R' independently represents an alkyl group, an alkylsulfonate group or an alkylammonium group;

R" represents a halogen atom, $SR^{IV}$, $OR^{IV}$, $SO_2R^{IV}$ or $NR^{IV}_2$;

each R'" independently represents a hydrogen atom, an alkyl group, —$COOR^{IV}$, —$OR^{IV}$, —$SR^{IV}$, —$NR^{IV}_2$ or a halogen atom; R'" can also be a benzofused ring;

$A^-$ represents an anion;

--- represents an optionally present carbocyclic five- or six-membered ring;

$R^{IV}$ represents a hydrogen atom, an alkyl or aryl group;

each b can independently be 0, 1, 2 or 3, wherein the IR absorber of formula (III) must not have any further charges in the IR-absorbing portion in addition to the positive charge shown.

$Z^1$ is preferably a $C(alkyl)_2$ group.

R' is preferably an alkyl group with 1 to 4 carbon atoms.

R" is preferably a halogen atom or $SR^{IV}$.

each R'" is preferably a hydrogen atom or halogen atom.

$R^{IV}$ is preferably an optionally substituted phenyl group or an optionally substituted heteroaromatic group.

The dotted line preferably represents the residue of a ring with 5 or 6 carbon atoms. The counterion $A^-$ is preferably a chloride ion, trifluoromethylsulfonate or a tosylate anion.

Of the IR dyes of formula (III), dyes with a symmetrical structure are especially preferred. Examples of especially preferred dyes include:

2-[2-[2-Phenylsulfonyl-3-[2-(1,3-dihydro-1,3,3-trimethyl-2H-indole-2-ylidene)-ethylidene]-1-cyclohexene-1-yl]-ethenyl]-1,3,3-trimethyl-3H-indolium-chloride, 2-[2-[2-thiophenyl-3-[2-(1,3-dihydro-1,3,3-trimethyl-2H-indole-2-ylidene)-ethylidene]-1-cyclohexene-1-yl]-ethenyl]-1,3,3-trimethyl-3H-indolium-chloride, 2-[2-[2-thiophenyl-3-[2-(1,3-dihydro-1,3,3-trimethyl-2H-indole-2-ylidene)-ethylidene]-1-cyclopentene-1-yl]-ethenyl]-1,3,3-trimethyl-3H-indolium-tosylate, 2-[2-[2-chloro-3-[2-(1,3-dihydro-1,3,3-trimethyl-2H-benzo[e]-indole-2-ylidene)-ethylidene]-1-cyclohexene-1-yl]-ethenyl]-1,3,3-trimethyl-1H-benzo[e]-indolium-tosylate and 2-[2-[2-chloro-3-[2-ethyl-(3H-benzthiazole-2-ylidene)-ethylidene]-1-cyclohexene-1-yl]-ethenyl]-3-ethyl-benzthiazolium-tosylate.

The following compounds are also IR absorbers suitable for use in the present invention:

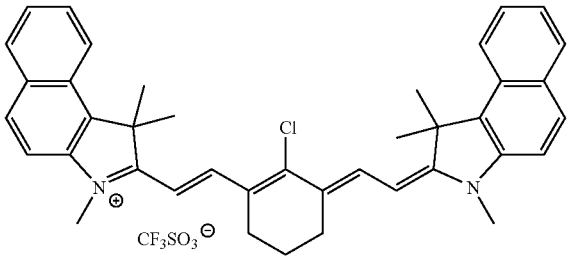

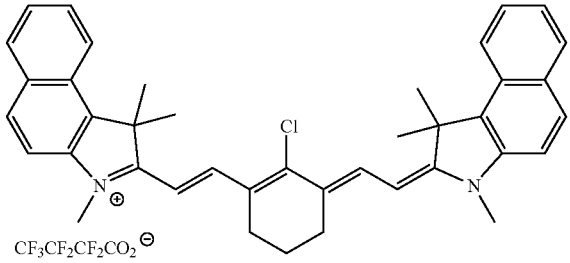

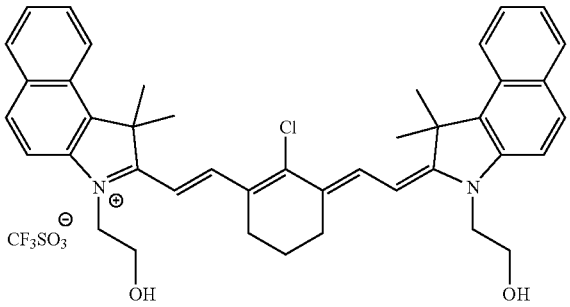

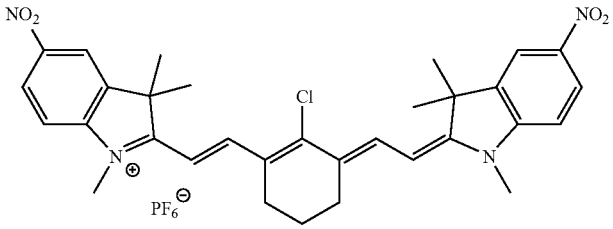

-continued
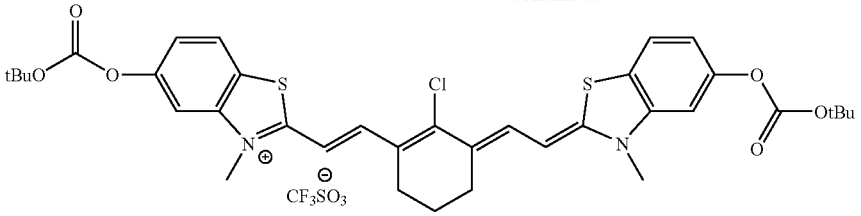
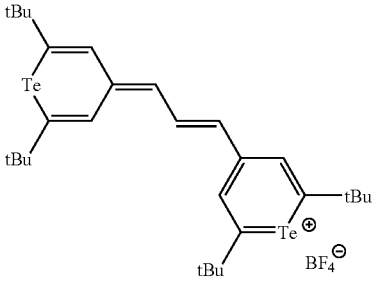
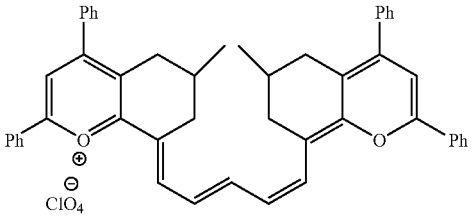
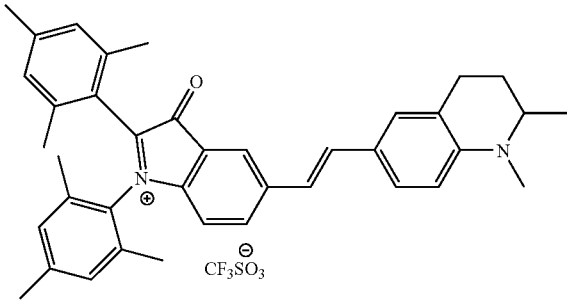
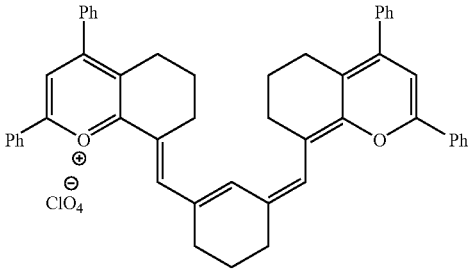
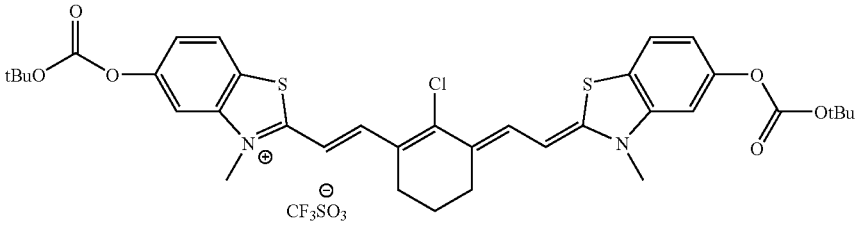

Suitable dye salts are for example triarylcarbonium dyes of the general structure (IV)

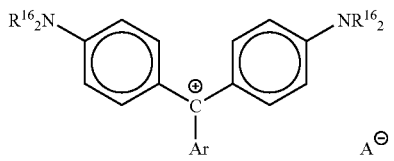

(IV)

wherein crystal violet

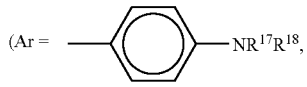

$R^{17}=R^{18}=CH_3$; $R^{16}=CH_3$);
Victoria blue 4R

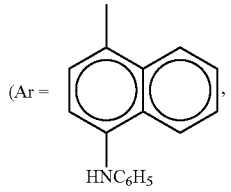

$R^{16}=CH_3$);
Victoria blue

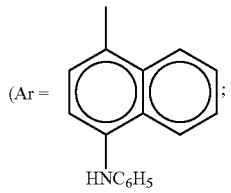

$R^{16}=C_2H_5$),
ethyl violet ($R^{16}=CH_3$;

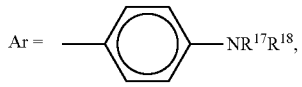

$R^{17}=R^{18}=C_2H_5$);
Victoria blue R

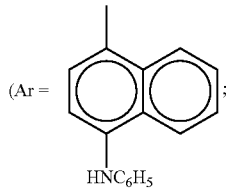

$R^{16}=C_2H_5$), malachite green ($R^{16}=CH_3$; Ar=phenyl) should be mentioned in particular and those of the general formula (V)

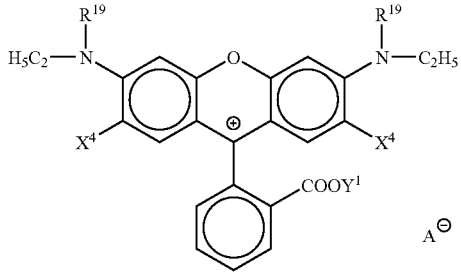

(V)

such as rhodamine 6G ($R^{19}=H$, $X^4=CH_3$, $Y^1=C_2H_5$) and rhodamine B ($R^{19}=C_2H_5$, $X^4=H$, $Y^1=H$).

The reaction of starting polymer (a) and salt (b) is carried out at room temperature or at elevated temperatures, e.g. at a temperature of 20° C. to 120° C., preferably at 20° C. to 80° C.

The reaction can take place in the absence or presence of an alkali reagent, such as e.g. an alkali metal hydroxide or alkaline-earth metal hydroxide. According to one embodiment, an alkali reagent is used in combination with an elevated temperature (e.g. 20° C. to 80° C.); when carried out at room temperature, the reaction preferably takes place in the absence of an alkaline reagent.

The reaction takes place in a solvent suitable for the starting polymer wherein the salt as well at least partially dissolves. Suitable solvents include for example alcohols, such as methoxyethanol, ketones, such as methyl ethyl ketone, esters, glycol ethers, ether and N-methylpyrrolidone.

The reaction time can vary in a wide range, e.g. from a few minutes to 24 hours.

The modified polymer is isolated by precipitation and filtration and subsequently dried. Water, water acidified with acid, such as e.g. hydrochloric acid or p-toluenesulfonic acid, can be used as precipitating agent. Drying is preferably carried out at a temperature of 30 to 60° C., with or without a vacuum.

The modified polymer of the present invention can e.g. be used in the production of radiation-sensitive elements, such as for example lithographic printing plate precursors and photomasks.

The modified polymers of the present invention are especially suitable for heat-sensitive elements. By using the modified polymers of the present invention in radiation-sensitive elements, the solvent resistance of such elements can be improved considerably. The modified polymers of the present invention are particularly suitable for coating heat-sensitive elements, such as lithographic printing plate precursors; they can be used both in negative working single-layer elements and in positive working dual-layer elements.

In the negative working single-layer elements of the present invention, a radiation-sensitive layer is provided on the hydrophilic surface of the substrate which layer is rendered insoluble in or impenetrable by aqueous alkaline developer by IR radiation und which comprises one or more modified polymers according to the present invention. Preferably, the layer furthermore comprises (i) at least one compound which forms an acid when heated (in the following also referred to as "latent Bronsted acid"), and (ii) a component cross-linkable by an acid (in the following also referred to as "cross-linking agent") or a mixture thereof and optionally (iii) a binder resin or a mixture thereof.

Ionic and non-ionic types of latent Bronsted acids are suitable. Examples of ionic latent Bronsted acids include onium salts, in particular iodonium, sulfonium, oxysulfoxonium, oxysulfonium, phosphonium, selenonium, telluronium, diazonium and arsonium salts. Specific examples are diphenyliodonium hexafluorophosphate, triphenylsulfonium hexafluoroantimonate, phenylmethyl-ortho-cyanobenzylsulfonium trifluoromethane-sulfonate and 2-methoxy-4-aminophenyl-diazonium-hexafluorophosphate.

Examples of non-ionic latent Bronsted acids include $RCH_2X$, $RCHX_2$, $RCX_3$, $R(CH_2X)_2$ and $R(CH_2X)_3$, wherein X represents Cl, Br, F or $CF_3SO_3$ and R is an aromatic, aliphatic or araliphatic group.

Suitable ionic latent Bronsted acids are also those of formula (VI)

$$X^{\oplus}R^{1a}R^{1b}R^{1c}R^{1d}W^{\ominus} \quad \text{(VI)}$$

wherein if X is iodine, $R^{1c}$ and $R^{1d}$ are lone electron pairs and $R^{1a}$ and $R^{1b}$ are aryl groups or substituted aryl groups, if X represents S or Se, $R^{1d}$ is a lone electron pair and $R^{1a}$, $R^{1b}$, $R^{1c}$ are independently selected from aryl groups, substituted aryl groups, an aliphatic group or substituted aliphatic group, if X represents P or As, $R^{1d}$ can be an aryl group, substituted aryl group, aliphatic group or substituted aliphatic group, and wherein W is selected from $BF_4$, $CF_3SO_3$, $SbF_6$, $CCl_3CO_2$, $ClO_4$, $AsF_6$ or $PF_6$.

$C_1$-$C_5$-Alkyl sulfonates, aryl sulfonates (e.g. benzoin tosylate, 2-hydroxymethyl benzointosylate and 2,6-dinitrobenzyltosylate) and N—$C_1$-$C_5$-alkyl-sulfonylsulfonamides (e.g. N-methanesulfonyl-p-toluene-sulfonamide and N-methanesulfonyl-2,4-dimethyl-benzene sulfonamide) are suitable as well.

Suitable specific onium compounds are for example described in detail in U.S. Pat. No. 5,965,319 and illustrated by formulas (I) to (III).

The latent Bronsted acids are preferably used in an amount of 0.5 to 50 wt.-%, especially preferred 3 to 20 wt.-%, based on the dry layer weight of the layer.

The cross-linking agent can for example be a resin selected from resols, $C_1$-$C_5$-alkoxymethyl melamines, $C_1$-$C_5$-alkoxymethyl-glycoluril resins, poly($C_1$-$C_5$-alkoxy-methylstyrenes) and poly($C_1$-$C_5$-alkoxymethyl acrylamides), epoxidized novolak resins and urea resins. In particular, compounds having at least two groups selected from hydroxymethyl, alkoxymethyl, epoxy and vinylether groups bonded to an benzene ring in a molecule can be used; phenol derivatives with at least two groups selected from hydroxymethyl and alkoxymethyl groups bonded to an aromatic ring, 3 to 5 aromatic rings and a molecular weight of 1,200 or less, as listed in U.S. Pat. No. 5,965,319, columns 31 to 37, are preferred.

The cross-linking agent is preferably used in an amount of 5 to 90 wt.-%, based on the dry layer weight, especially preferred 10 to 60 wt.-%.

The modified polymer of the present invention can act as the binder in the radiation-sensitive layer. However, one or more additional binders can optionally be present as well, for example selected from polymers having an alkali-soluble group such as novolaks, acetone-pyrogallol resin, polyhydroxystyrenes and hydroxystyrene-N-substituted maleimides copolymers, as listed as component (C) in U.S. Pat. No. 5,965,319, or polymers as listed as binder resin in U.S. Pat. No. 5,919,601.

The binder is preferably used in an amount of 0 to 90 wt.-%, based on the dry layer weight, especially preferred 5 to 60 wt.-%.

In principle, all known heat-sensitive elements with a single-layer structure, such as e.g. those described in U.S. Pat. Nos. 5,919,601, 5,965,319, 5,371,907 and WO 00/17711, can be altered by the additional use of the modified polymer of the present invention in the coating. Preferably, the modified polymer is used in a single-layer structure in an amount of 5 to 80 wt.-%, based on the dry layer weight, especially preferred 20 to 60 wt.-%.

In the positive working dual-layer elements of the present invention, a first layer is provided on the hydrophilic surface of the substrate which is soluble in aqueous alkaline developer, whose solubility is not changed by exposure to IR radiation and which comprises a modified polymer according to the present invention; on the first layer, a top layer is provided which is insoluble in aqueous alkaline developer, which is rendered soluble in or penetrable by the developer by exposure to IR radiation.

Known principles can be applied for the top layer:

(a) A polymer insoluble in strongly alkaline aqueous developer (pH>11) is used which is rendered soluble in or penetrably by the developer by IR irradiation; such systems are for example described in U.S. Pat. No. 6,352,812.

(b) A polymer soluble in strongly alkaline aqueous developer (pH>11) is used whose solubility is reduced to such a high degree by the simultaneously present solubility inhibitor that the layer is not soluble or penetrable under developing conditions; the interaction between the polymer and the inhibitor is weakened by IR radiation to such a degree that the exposed (heated) areas of the layer are rendered soluble in or penetrable by the developer. Such systems are for example described in U.S. Pat. Nos. 6,352,811 and 6,358,669. It is not necessary that the polymer and the solubility inhibitor be two separate compounds, but polymers can be used which at the same time have a solubility inhibiting moiety, such as e.g. the functionalized resins described in US 2002/0,150,833 A1, U.S. Pat. Nos. 6,320,018 B and 6,537,735 B, such as e.g. functionalized novolaks.

(c) A polymer insoluble in aqueous alkaline developer with pH<11 (but soluble at pH>11) is used, which upon exposure to IR radiation becomes soluble in such a developer with pH<11, and the exposed element is developed with an alkaline developer with pH<11. Such a system is for example described in WO 02/14071.

(Meth)acryl polymers and copolymers, polystyrene, styrene/(meth)acrylic acid ester copolymers, polyesters, polyamides, polyureas, polyurethanes, nitrocelluloses, epoxy resins and combinations thereof can be used for a top layer of the type (a) as described above, as long as they are insoluble in alkaline developer at pH>11, but are rendered soluble in or penetrable by the developer by IR radiation. The polymer for a top layer of type (a) is applied in such an amount that preferably a top layer with a dry layer weight of 0.1 to 1.5 $g/m^2$ is obtained, especially preferred 0.2 to 0.9 $g/m^2$.

Polymers and copolymers with phenolic OH groups, i.e. phenolic resins, are preferably used for a top layer of the type (b) as described above. Suitable phenolic resins include e.g. novolaks, resols, acrylic resins with phenolic side chains and polyvinyl phenolic resins, whereby novolaks are especially preferred.

Novolak resins suitable for the present invention are condensation products of suitable phenols, e.g. phenol itself, C-alkyl-substituted phenols (including cresols, xylenols, p-tert-butylphenol, p-phenylphenol and nonylphenols), and of diphenols (e.g. bisphenol-A), with suitable aldehydes such as formaldehyde, acetaldehyde, propionaldehyde and furfuraldehyde. The type of catalyst and the molar ratio of the reactants determine the molecular structure and thus the physical properties of the resin. An aldehyde/phenol ratio of about 0.5:1 to 1:1, preferably 0.5:1 to 0.8:1, and an acid catalyst are used in order to produce those phenolic resins known as "novolaks" which have a thermoplastic character. As used in the present application, however, the term "novolak resin" should also encompass the phenolic resins known as "resols" which are obtained at higher aldehyde/phenol ratios and in the presence of alkaline catalysts.

The solubility inhibitor (also referred to as "insolubilizer") present in the top layer of type (b) can be an insolubilizer already described in the prior art, or a different one.

Suitable insolubilizers include for example the compounds described in WO 98/42507 and EP-A 0 823 327 which are not photosensitive and comprise functional groups that can enter into a hydrogen bonding with the phenolic OH groups of novolak resins. WO 98/42507 mentions sulfone, sulfoxide, thion, phosphinoxide, nitrile, imide, amide, thiol, ether, alcohol, urea, nitroso, azo, azoxy and nitro groups, halogens and in particular keto groups as suitable functional groups. Xanthone, flavanone, flavone, 2,3-diphenyl-1-indenone, pyrone, thiopyrone and 1'-(2'-acetonaphthonyl)benzoate are mentioned as examples of suitable compounds.

In WO 99/01795, polymers with specific functional groups Q which preferably do not comprise diazide groups, acid groups or acid-forming groups are used as insolubilizers, and according to a preferred embodiment, Q is selected from amino, monoalkylamino, dialkylamino, amido, monoalkylamido, dialkylamido groups, fluorine atoms, chlorine atoms, carbonyl, sulfinyl or sulfonyl groups. These polymeric insolubilizers can also be used in the present invention.

The insolubilizers described in WO 99/01796, in this case compounds with diazide units, can be used in the present invention as well.

Another group of insolubilizers suitable for use in the present invention is described in WO 97/39894. They are e.g. nitrogen-containing compounds wherein at least one nitrogen atom is quaternized and forms part of a heterocyclic ring; examples include e.g. quinolinium compounds, benzothiazolium compounds and pyridinium compounds, and in particular cationic trimethylmethane dyes such as Victoria Blue (C I Basic Blue 7), crystal violet (C I Basic Violet 3) and ethyl violet (C I Basic Violet 4). Furthermore, compounds with carbonyl function such as N-(4-bromobutyl)-phthalimide, benzophenone and phenanthrenequinone are mentioned. Compounds of the formula $Q_1$-$S(O)_n$-$Q_2$ (wherein $Q_1$=optionally substituted phenyl or alkyl group; n=0, 1 or 2; $Q_2$=halogen atom or alkoxy group), Acridine Orange Base and ferrocenium compounds can be used as well.

If the optionally present IR absorbers comprise the structural elements mentioned in WO 97/39894, they also function as insolubilizers.

The functionalized novolaks described in US 2002/0,150,833 A1 and U.S. Pat. No. 6,320,018 B can be used in the heat-sensitive elements of the present invention as well. These novolaks contain substituents which allow a two- or four-center hydrogen bonding (preferably a quadrupole hydrogen bonding) between the polymer molecules. This also decreases the aqueous alkaline developer solubility of the underlying novolak. Such hydrogen bonds are broken by heating and the original solubility of the novolak is restored. If such a functionalized novolak is used, it assumes the function of components (i) and (ii) of the heat-sensitive composition so that the additional use of a novolak without corresponding functional groups and/or an insolubilizer as described above it not necessary, but not excluded, either.

The functionalized novolaks comprise at least one covalently bonded unit and at least one non-covalently bonded unit, with the non-covalent bonding being thermally unstable; these novolaks have a two- or four-center hydrogen bonding at essentially every non-covalently bonded unit. A preferred group of such functionalized novolaks which can be used as novolak with a simultaneous insolubilizing function can be described with the following formula (VII):

(VII)

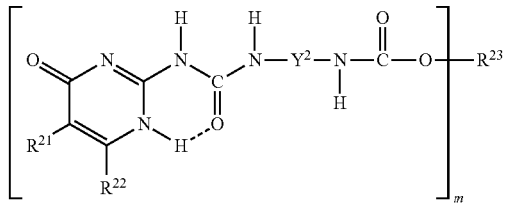

wherein $R^{21}$ and $R^{22}$ are independently selected from a hydrogen atom and a cyclic or straight or branched saturated or unsaturated hydrocarbon group with preferably 1 to 22 carbon atoms (preferably hydrogen and $C_1$-$C_4$ alkyl), $R^{23}$ is a phenolic group derived from a novolak $R^{23}(OH)_p$, $Y^2$ is a divalent cyclic or straight or branched saturated or unsaturated hydrocarbon group with preferably 1 to 22 carbon atoms derived from a diisocyanate of the formula $Y(NCO)_2$ (e.g. isophorone diisocyanate, toluene-1,2-diisocyanate, 3-isocyanatomethyl-1-methylcyclo-hexylisocyanate), m is at least 1 and p is 1 or 2.

The preparation of functionalized novolaks of formula (I) can be inferred from US 2002/0,150,833 A1.

Another class of suitable functionalized resins, such as e.g. functionalized phenolic resins and in particular functionalized novolaks, is disclosed in U.S. Pat. No. 6,537,735 B. While the non-functionalized resin is soluble in aqueous alkaline developer, the functionalized resin is insoluble in the developer; however, the application of heat (for example generated by IR radiation) renders it soluble in the developer. Preferably, the non-functionalized resin comprises OH or SH groups which in the functionalized resin are at least partially converted to covalently bonded functional groups Q; preferably, the functional groups Q are formed via an esterification reaction of the OH groups and are preferably selected from —O—$SO_2$tolyl, —O-dansyl, —O—$SO_2$-thienyl, —O—$SO_2$-naphthyl and —O—CO-phenyl. The ratio of functional groups Q to OH groups is preferably 1:100 to 1:2, more preferred 1:50 to 1:3. The novolak resins, resols, acrylic resins with phenolic side chains and hydroxystyrenes described above can for example be used as non-functionalized resins. An especially preferred functionalized resin of this class is a phenolic resin (preferably a novolak), partially (e.g. 10 to 20%) esterified with toluenesulfonic acid or sulfonic acid chloride; however, all the other functionalized resins described in U.S. Pat. No. 6,537,735 can be used in the present invention as well.

Although all the insolubilizers mentioned above can be used in the heat-sensitive coating of the present invention, the following are preferred: Cyanine dyes, triarylmethane dyes, quinolinium compounds, the above insolubilizers with (a) keto group(s) and the above insolubilizers with (a) sulfone group(s), as well as functionalized novolaks. The cyanine dyes, triarylmethane dyes, quinolinium compounds, ketones and sulfones can be used as low-molecular substances or bonded to a polymer.

A single insolubilizer or mixtures of two or more compounds can be used in the heat-sensitive elements of the present invention.

The amount of insolubilizer(s) is not particularly restricted as long as it reduces the aqueous alkaline developer solubility of the novolak. However, the solubility reduction has to take place to such an extent that when an aqueous alkaline developer is used, the heated areas of the coating are removed considerably faster than the non-heated areas.

Independently of whether the insolubilizer also functions as IR absorber, it is preferably present in an amount of at least 0.1 wt.-% based on the dry layer weight, more preferred at least 0.5 wt.-%, especially preferred at least 2 wt.-% and particularly preferred at least 5 wt.-%. Preferably, no more than 40 wt.-%, more preferred no more than 25 wt.-%, are used.

In top layers of type (b), the soluble polymer is preferably present in an amount of 60 to 99 wt.-%, based on the dry layer weight of the top layer, more preferred 80 to 98 wt.-%.

For a top layer of type (c), polymers with phenolic OH groups or active amide groups (NH) can be used. In top layers of type (c), an insolubilizer is not required, but can be present.

Both the radiation-sensitive layer in the single-layer elements and the lower layer and/or top layer in the dual-layer elements can optionally comprise further additives:

The coating solutions used can furthermore comprise dyes or pigments having a high absorption in the visible spectral range in order to increase the contrast ("contrast dyes and pigments"). Particularly suitable dyes and pigments are those that dissolve well in the solvent or solvent mixture used for coating or are easily introduced in the disperse form of a pigment. Suitable contrast dyes include inter alia rhodamine dyes, triarylmethane dyes such as Victoria blue R and Victoria blue B0, crystal violet and methyl violet, anthraquinone pigments, azo pigments and phthalocyanine dyes and/or pigments.

Furthermore, the coating solutions can comprise surfactants (e.g. anionic, cationic, amphoteric or non-ionic tensides or mixtures thereof). Suitable examples include fluorine-containing polymers, polymers with ethylene oxide and/or propylene oxide groups, sorbitol-tri-stearate and alkyl-di-(aminoethyl)-glycines.

The coating solutions can furthermore comprise print-out dyes such as crystal violet lactone or photochromic dyes (e.g. spiropyrans etc.).

Also, flow improvers can be present in the coating solutions, such as poly(glycol)ether-modified siloxanes.

Other coating additives can of course be present as well.

If the modified polymer was obtained by reacting a suitable polymer as described above and an IR absorber salt, it is not necessary for an additional IR absorber to be present in the coating solutions; however, it is possible within the framework of the present invention to use an additional IR absorber. If no IR absorber salt was used to prepare the modified polymer, an IR absorber is preferably added to the coating solution; in dual-layer elements it can preferably be present in the lower layer or both in the lower layer and the top layer.

In dual-layer imageable elements, the modified polymer is preferably present in the lower layer in an amount of 5 to 100 wt.-%, especially preferred 50 to 100 wt.-%, based on the dry layer weight. It goes without saying that an upper limit of 100% for the modified polymer is only possible if the polymer was obtained by reaction with a cationic absorber and therefore no additional IR absorber is required in the layer.

A dimensionally stable plate or foil-shaped material is preferably used as a substrate in the production of printing plate precursors. Preferably, a material is used as dimensionally stable plate or foil-shaped material that has already been used as a substrate for printing forms. Examples of such substrates include paper, paper coated with plastic materials (such as polyethylene, polypropylene, polystyrene), a metal plate or foil, such as e.g. aluminum (including aluminum alloys), zinc and copper plates, plastic films made e.g. from cellulose diacetate, cellulose triacetate, cellulose propionate, cellulose acetate, cellulose acetatebutyrate, cellulose nitrate, polyethylene terephthalate, polyethylene, polystyrene, polypropylene, polycarbonate and polyvinyl acetate, and a laminated material made from paper or a plastic film and one of the above-mentioned metals, or a paper/plastic film that has been metallized by vapor deposition. Among these substrates, an aluminum plate or foil is especially preferred since it shows a remarkable degree of dimensional stability, is inexpensive, thermally stable and furthermore exhibits excellent adhesion to the coating. Furthermore, a composite film can be used wherein an aluminum foil has been laminated onto a polyethylene terephthalate film.

A metal substrate, in particular an aluminum substrate, is preferably subjected to a surface treatment, for example graining by brushing in a dry state or brushing with abrasive suspensions, or electrochemical graining, e.g. by means of a hydrochloric acid electrolyte, and optionally anodizing.

Furthermore, in order to improve the hydrophilic properties of the surface of the metal substrate that has been grained and optionally anodized in sulfuric acid or phosphoric acid, the metal substrate can be subjected to an aftertreatment with an aqueous solution of e.g. sodium silicate, calcium zirconium fluoride, polyvinylphosphonic acid or phosphoric acid. Within the framework of the present invention, the term "substrate" also encompasses an optionally pre-treated substrate exhibiting, for example, a hydrophilizing layer on its surface.

The details of the above-mentioned substrate pre-treatment are known to the person skilled in the art.

As used in the present invention, the term "(meth)acrylate" encompasses both "acrylate" and "methacrylate"; analogously, the same applies to the term "(meth)acrylic acid".

For the purpose of the present invention, a polymer is considered soluble in an aqueous alkaline developer if 1 g or more dissolve in 100 ml of developer at room temperature.

The invention will be explained in more detail in the following examples; however, they shall not restrict the invention in any way.

EXAMPLES

Preparation Example 1

1. Synthesis of Polymer 1A

To a solution of 20 g Gantrez® AN 119 (copolymer of vinylether and maleic acid anhydride, available from GAF Chemical Corporation USA; molar ratio of the comonomers 1:1) in 100 g anhydrous N-methylpyrrolidinone were added 24.02 g anhydrous glacial acetic acid slowly under stirring; care was taken that no resin would precipitate. To this solution, a mixture of 5.96 g aniline and 8.78 g p-aminobenzoic acid was added very slowly at room temperature under stirring. The solution was stirred for 16 hours. After all the anhydride groups had reacted (confirmed by IR spectroscopy), the solution was heated to 100° C. for 3 hours. The solution was then added to 2 l water containing 5 ml concentrated hydrochloric acid, causing the polymer to precipitate. The precipitated polymer was filtered off and dried at 50° C.

2. Synthesis of Polymer 1B 0.231 g solid NaOH were added to 9.98 g polymer 1A, dissolved in 51 g methoxyethanol, and the mixture was stirred until all constituents had dissolved. 4.28 g IR Trump dye were added to this solution and stirred overnight at room temperature. The reaction mixture was slowly poured into a mixture of 1,400 g $H_2O$ and 1.13 g p-toluenesulfonic acid. The green precipitate was filtered off, washed and dried at 50° C. The filtrate was clear and colorless.

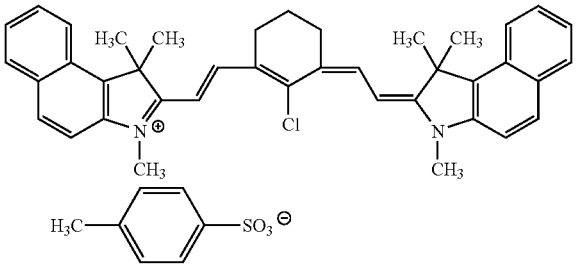

Trump Dye

Preparation Example 2

1. Synthesis of Polymer 2A

In a three-necked flask, equipped with a stirrer and a nitrogen inlet, 260 g of a solvent mixture of dioxolane and methanol (volume ratio 1:1), 25.8 g N-methoxymethyl methacrylamide, 12.8 g methacrylamide, 69.3 g N-phenylmaleimide and 21.5 g methacrylic acid were dissolved by heating to 60° C. in a nitrogen atmosphere. 1.0 g azo-bis-isobutyronitrile (AIBN) was added to this mixture. After 6 hours, another 0.7 g AIBN were added and the reaction was continued for 12 hours. The copolymer was precipitated in $H_2O$, filtered off and dried for 24 hours at 60° C.

2. Synthesis of Polymer 2B 0.19 g NaOH and 3.53 g IR Trump dye were added to 20 g polymer 2A dissolved in 100 g methoxyethanol. The solution was stirred for 4 hours and then heated to 80° C. for 60 minutes. The colored polymer was precipitated in water, filtered off and dried.

Preparation Example 3

1. Synthesis of Polymer 3A

Polymer 3A was prepared like polymer 2A, but the following molar ratio of the monomers was used:

N-Methoxymethyl methacrylamide:methacrylamide:N-phenylmaleimide:methacrylic acid=15:20:40:25

2. Synthesis of Polymer 3B 0.234 g solid NaOH were added to 10 g polymer 3A dissolved in 50 g methoxyethanol and the mixture was stirred until all constituents had dissolved. To this solution, 3 g benzyltributyl ammoniumchloride were added and the mixture was stirred overnight at room temperature. Then the reaction mixture was heated to 80° C. for 60 minutes and subsequently slowly poured into a mixture of 1,400 g $H_2O$ and 1.13 g p-toluenesulfonic acid. The resulting precipitate was filtered off, washed and dried at 50° C.

3. Synthesis of Polymer 3C

The synthesis was carried out like the synthesis of polymer 3B but without the addition of NaOH.

Preparation Example 4

1. Synthesis of Polymer 4A

Polymer 4A was prepared by acetalation of polyvinyl alcohol (Mowiol®10-98) with butyraldehyde/acetaldehyde/4-formylbenzoic acid (molar ratio vinyl alcohol acetaldehyde: butyraldehyde:4-formylbenzoic acid:vinyl acetate=0.371: 0.0943:0.221:0.282:0.0319) under standard conditions. The resulting polyvinyl acetal (Polymer 4A) had an acid value of 117.

2. Synthesis of Polymer 4B

Polymer 4B was prepared analogously to polymer 2B, however, polymer 4A was used instead of polymer 2A. A polymer comprising 15 wt.-% IR dye was obtained.

Preparation Example 5

1. Synthesis of Polymer 5A 800 ml methyl glycol were provided in a 11 round-bottomed flask equipped with a stirrer, a thermometer, a nitrogen inlet and a reflux condenser. 47.25 g methacrylic acid, 89.5 g N-phenylmaleimide and 73.4 g methacrylamide were added and dissolved under stirring. 3.4 g AIBN were added and heated to 60° C. for 22 hours. Then methanol was added and the resulting precipitate was filtered off, washed twice with methanol and dried in the oven at 40° C. for 2 days.

2. Synthesis of Polymer 5B 0.234 g solid NaOH were added to 10 g polymer 5A dissolved in 50 g methoxyethanol and the mixture was stirred until all constituents had dissolved. To this solution, 3 g Victoria Blue BO (cationic triarylmethane dye) were added and the mixture was stirred overnight at room temperature. Then the reaction mixture was heated to 80° C. for 30 minutes and subsequently slowly poured into 1,400 g $H_2O$. The resulting precipitate was filtered off, washed and dried at 50° C.

3. Synthesis of Polymer 5C

Polymer 5C was prepared like polymer 5A, but the following molar ratio of the monomers was used:

Methacrylamide:N-phenylmaleimide:methacrylic acid 35:45:20

Preparation Example 6

1. Synthesis of Polymer 6A

Polymer 6A was prepared like polymer 2A, but the following molar ratio of the monomers was used:

N-Methoxymethyl methacrylamide:methacrylamide:N-phenylmaleimide:methacrylic acid=25:15:35:25.

2. Synthesis of Polymer 6B 0.082 g solid $LiOH*H_2O$ were added to 10 g polymer 6A dissolved in 50 g methoxyethanol and the mixture was stirred overnight. Then the reaction mixture was heated to 80° C. for 60 minutes and subsequently slowly poured into 1,000 g $H_2O$. The resulting precipitate was filtered off, washed and dried at 50° C.

Examples 1 to 7 and Comparative Examples 1 to 6

An electrochemically grained and anodized lithographic aluminum substrate that had been subjected to a treatment with polyvinylphosphoric acid was coated with the different coating solutions. After drying in an oven for 45 seconds at 135° C., a dry layer weight of the coating of 1.38 g/m$^2$ was obtained in each case.

The coating solutions contained a mixture of methyl ethyl ketone (65 vol.-%), Dowanol PM (15 vol.-%), γ-butyrolactone (10 vol.-%) and $H_2O$ (10 vol.-%) as a solvent.

The components listed in Table 1 were used as solid components; the amounts are given in wt.-%, based on the total solids content.

TABLE 1

| Polymer | Example | Coating formulation |
|---|---|---|
| Polymer 1A | Comp. 1 | 84.65% Polymer 1A + 0.35% Byk 307 + 15% IR Trump |
| Polymer 1B | Example 1 | 99.65% Polymer 1B + 0.35% Byk 307 |
| Polymer 2A | Comp. 2 | 84.65% Polymer 2A + 0.35% Byk 307 + 15% IR Trump |
| Polymer 2B | Example. 2 | 99.65% Polymer 2B + 0.35% Byk 307 |
| Polymer 3A | Comp. 3 | 84.65% Polymer 3A + 0.35% Byk 307 + 15% IR Trump |
| Polymer 3B | Example 3 | 84.65% Polymer 3B + 0.35% Byk 307 + 15% IR Trump |
| Polymer 3C | Example 4 | 84.65% Polymer 3C + 0.35% Byk 307 + 15% IR Trump |
| Polymer 4A | Comp. 4 | 84.65% Polymer 4A + 0.35% Byk 307 + 15% IR Trump |
| Polymer 4B | Example 5 | 99.65% Polymer 4B + 0.35% Byk 307 |
| Polymer 5A | Comp. 5 | 84.65% Polymer 5A + 0.35% Byk 307 + 15% IR Trump |
| Polymer 5B | Example 6 | 84.65% Polymer 5B + 0.35% Byk 307 + 15% IR Trump |
| Polymer 6A | Comp. 6 | 84.65% Polymer 6A + 0.35% Byk 307 + 15% IR Trump |
| Polymer 6B | Example 7 | 84.65% Polymer 6B + 0.35% Byk 307 + 15% IR Trump |

The thus coated plates were tested for their solvent resistance. For this purpose, a piece of the plate was immersed in mixture 1 (Butyl Cellosolve/water; 80:20 volume ratio) or 2 (UV Wash® from Varn Products/water; 80:20 volume ratio), for 5 minutes at room temperature, rinsed with water and dried; then the weight loss of the coating was determined gravimetrically. The results are shown in Table 2.

TABLE 2

| Example | Mixture 1 | Mixture 2 |
|---|---|---|
| Comp. 1 | 100% | — |
| Ex. 1 | 12% | — |

TABLE 2-continued

| Example | Mixture 1 | Mixture 2 |
|---|---|---|
| Comp. 2 | 24% | 100% |
| Ex. 2 | 10% | 38% |
| Comp. 3 | 30% | 94% |
| Ex. 3 | 20% | 17% |
| Ex. 4 | 27% | 20% |
| Comp. 4 | 92% | 51% |
| Ex. 5 | 17% | 12% |
| Comp. 5 | 19% | 67% |
| Ex. 6 | 10% | 20% |
| Comp. 6 | 61% | 100% |
| Ex. 7 | 16.0% | 90% |

The results in Table 2 show that by using the polymers of the present invention with coordinated dye cation or IR dye cation, compared to a mere mixture of polymer and IR dye, a marked improvement in solvent resistance is achieved.

Example 8 and Comparative Example 7

Dual-layer heat-sensitive printing plates were prepared by coating an aluminum substrate as described in Example 1 with the coating solutions described in Example 2 (Example 8) and Comparative Example 2 (Comparative Example 7), respectively, such as to obtain a dry layer weight of 1.38 g/m$^2$. Then a top layer with a dry layer weight of 0.8 g/m$^2$ was applied to each substrate; for this purpose, a solution of 8 g of an N13 novolak tosylated to a degree of 15 mole-% (available from Diversitec Corp., USA) in 40 g of a mixture of 92 vol.-% diethyl ketone and 8 vol.-% Dowanol PMA was used.

The thus produced dual-layer plates were image-wise (solids and different pixel patterns) exposed in a Creo Quantum® 800 image-setter with 12 W and 225 rpm (which results in 140 mJ/cm$^2$). Then the plates were developed at 24° C. in a Mercury® processor using Goldstar® developer which resulted in good image quality and clean backgrounds in both cases.

When developer 956® was used at 24° C. instead of Goldstar®, good image quality and a clean background were obtained as well.

It can be inferred from these results that the use of a polymer according to the present invention with a coordinated IR dye does not affect the sensitivity and developability compared to a plate prepared by using a mere mixture of a polymer and an IR dye.

The invention claimed is:

1. A radiation-sensitive positive working element comprising (a) a substrate with a hydrophilic surface, (b) a first layer on the hydrophilic surface of the substrate and (c) a top layer, wherein the first layer comprises a modified polymer that is soluble in aqueous alkaline developer and the solubility is not changed by IR radiation and wherein the top layer is insoluble in or impenetrable by aqueous alkaline developer, but is rendered soluble in or penetrable by aqueous alkaline developer by IR radiation, wherein the modified polymer is a reaction product of (a) a polymer with —COOH, —$SO_3H$, —$PO_3H_2$ and/or —$PO_4H_2$ in the side chains, wherein the polymer is soluble in aqueous alkaline solutions and the solubility is not changed by IR radiation, with (b) a salt with an inorganic or organic cation, to replace at least one hydrogen atom with said inorganic or organic cation, wherein the modified polymer is soluble in aqueous alkaline solutions and the solubility is not changed by IR radiation, said polymer (a) being selected from the group consisting of:

acidic polyvinyl acetals, (meth)acrylic acid polymers and copolymers, derivatives of methylvinylether/maleic acid anhydride copolymers, derivatives of styrene/maleic acid anhydride copolymers comprising an N-substituted cyclic imide unit, copolymers comprising a monomer in polymerized form that contains a urea group in its side chain, and mixtures of any of these classes of polymers.

2. A radiation-sensitive element according to claim 1, wherein the top layer comprises a polymer insoluble in strongly alkaline aqueous developer which is rendered developer-soluble or penetrable by IR radiation.

3. The radiation-sensitive element according to claim 1, wherein the top layer comprises a polymer soluble in strongly alkaline aqueous developer and an insolubilizer, wherein the interaction between polymer and insolubilizer is weakened by IR radiation to such a degree that the exposed areas are rendered soluble in or penetrable by the developer.

4. The radiation-sensitive element according to claim 1, wherein the top layer comprises a polymer insoluble in aqueous alkaline developer with a pH<11 but soluble at a pH>11, which is rendered soluble in or penetrable by a developer at pH<11 by exposure to IR radiation.

5. A process for the production of an imaged element comprising:

(a) providing a radiation-sensitive element as defined in claim 1;

(b) image-wise exposure of the element to IR radiation or image-wise exposure of the element to a heat source;

(c) developing the image-wise exposed element with an aqueous alkaline developer.

6. The process according to claim 5, wherein image-wise exposure in step (b) is carried out by means of a computer-controlled IR laser.

7. The element of claim 1 wherein component (b) is a salt with an organic cation.

8. The element of claim 7 wherein the salt is an IR absorber whose cation is the IR-absorbing portion.

9. The element of claim 8 wherein the IR absorber is a cyanine dye of the formula (III)

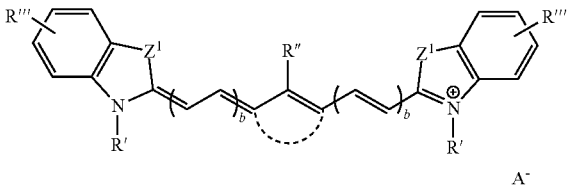

wherein each $Z^1$ independently represents S, O, $NR^{IV}$ or $C(alkyl)_2$;

each R' independently represents an alkyl group, an alkylsulfonate group or an alkylammonium group;

R'' represents a halogen atom, $SR^{IV}$, $OR^{IV}$, $SO_2R^{IV}$ or $NR^{IV}{}_2$;

each R'' independently represents a hydrogen atom, an alkyl group, —$COOR^{IV}$, —$OR^{IV}$, —$SR^{IV}$, —$NR^{IV}{}_2$ or a halogen atom; R''' can also be a benzofused ring;

$A^-$ represents an anion;

--- represents an optionally present carbocyclic five- or six-membered ring;

$R^{IV}$ represents a hydrogen atom, an alkyl or aryl group;

each b can independently be 0, 1, 2 or 3, wherein, however, the IR absorber of formula (III) must not have any further charges in the IR-absorbing portion in addition to the positive charge shown.

10. The element of claim 1 wherein the salt is a colorant whose cation is the chromophoric portion.

11. The element of claim 10 wherein the colorant is a triarylcarbonium pigment.

12. The element of claim 1 wherein the cation of the salt is an alkali metal cation.

13. The element of claim 1 wherein component (a) is an acidic polyvinyl acetal, a (meth)acrylic acid polymer or copolymer, or a mixture thereof.

* * * * *